US006651426B2

(12) United States Patent
Lange

(10) Patent No.: US 6,651,426 B2
(45) Date of Patent: Nov. 25, 2003

(54) LOADER DRIVE SYSTEM

(75) Inventor: Kenneth J. Lange, Yorkton (CA)

(73) Assignee: Leon's Mfg. Company, Inc. (CA)

( * ) Notice: Subject to any disclaimer, the term of this patent is extended or adjusted under 35 U.S.C. 154(b) by 0 days.

(21) Appl. No.: 10/093,085

(22) Filed: Mar. 7, 2002

(65) Prior Publication Data

US 2003/0167762 A1 Sep. 11, 2003

(51) Int. Cl.[7] ..... F16D 31/02
(52) U.S. Cl. ..... 60/421; 60/486
(58) Field of Search ..... 60/421, 484, 486

(56) References Cited

U.S. PATENT DOCUMENTS

| | | | | |
|---|---|---|---|---|
| 3,208,221 A | | 9/1965 | Schuetz | |
| 3,466,770 A | | 9/1969 | Morrison et al. | |
| 3,720,059 A | | 3/1973 | Schurawski et al. | |
| 3,800,669 A | * | 4/1974 | Distler | 60/421 |
| 3,922,855 A | | 12/1975 | Bridwell et al. | |
| 3,960,284 A | | 6/1976 | Carpenter | |
| 4,024,710 A | | 5/1977 | Zelle | |
| 4,112,821 A | | 9/1978 | Bianchetta | |
| 4,986,072 A | * | 1/1991 | Kubomoto | 60/421 |
| 5,148,676 A | * | 9/1992 | Moriya et al. | 60/486 |
| 5,680,759 A | | 10/1997 | Chung | |
| 6,244,048 B1 | * | 6/2001 | Tanaka et al. | 60/421 |

FOREIGN PATENT DOCUMENTS

| | | |
|---|---|---|
| CA | 1032443 | 6/1978 |

* cited by examiner

*Primary Examiner*—Edward K. Look
*Assistant Examiner*—Michael Leslie
(74) *Attorney, Agent, or Firm*—David L. Davis

(57) ABSTRACT

A hydraulically operated drive system for mini-loaders and like machines is disclosed. The system incorporates hydraulically operated wheels or sprocket/track arrangements as well as auxiliary functional mechanisms. Tandem hydraulic pumps are used, each one thereof being connected to a multiple spool series valve, providing two separated hydraulic circuits, each of which has a separate relief valve. Each multiple spool series valve controls a wheel motor and a loader/lift or like function. Each multiple spool series valve includes a single-acting spool connected to a common spool valve to provide auxiliary power control.

9 Claims, 2 Drawing Sheets

LOADER DRIVE SYSTEM

FIELD OF THE INVENTION

This invention relates to drive systems for mini-loader or like machines which incorporate hydraulically driven wheels or sprocket/tracks as well as hydraulically operated functional mechanisms. While the present description refers to a drive system for a loader or mini-loader machine, it will be understood that the present invention is not restricted to this type of unit. The invention is applicable to units that incorporate tracks instead of wheels; units that could be a backhoe or other type of machine, any of which would benefit from the drive system of the present invention.

BACKGROUND OF THE INVENTION

There are several manufacturers producing compact earth moving machines such as small loaders. Typical examples are now made by Leon's Manufacturing Company, Inc.; Toro and Kanga. A typical, conventional arrangement is illustrated and described in Canadian Patent 1,236,053 of May 3, 1988.

With minor variations, these machines all use a common basic drive system in which a single hydraulic pump, usually driven by a constant speed gasoline engine, is connected to a control valve that provides control for all drive hydraulic motors, loader cylinders, as well as auxiliary functions. A recent innovation in the art has been to provide a second hydraulic pump for auxiliary functions but the drives are operated by a common control valve and pump.

In order for this convention arrangement to operate properly, the control valve must be a "series" valve. When more than one lever is operated on a normal control valve, hydraulic oil is allowed to flow to more than one function. However, the oil will follow the path of least resistance and only the function which requires the lowest pressure at the time will actually operate. Accordingly, if such a valve is used in a basic drive system for example, it would not be possible to drive the unit in a straight line or lift the load while moving. Thus, the unit would be uncontrollable.

Series valves solve this problem by forcing the oil coming "back" to the valve from one function to go "out" to the next function when a second lever is pulled. Thus, several functions can be operated simultaneously. For example, the machine can be driven properly as the oil coming out of one wheel motor is going into the other one.

However, one main disadvantage of this conventional system using a series control valve is that the pressures are additive because any functions will see any other functions downstream thereof as "back pressure". Accordingly, if the machine was being driven in a straight line and the pressure required to turn each wheel motor was 1000 psi, the total pressure required would be 2000 psi. If an operator tried to lift a load at the same time and the load required 1500 psi to lift, the total system pressure would become 3000 psi.

Generally speaking, the hydraulic systems in these units operate at a maximum pressure of approximately 3000 psi and when this pressure is reached, the system relief valve opens, dumping all the oil back to the reservoir, and everything stops until the pressure drops below the limit again. The result of this is that an operator would either have to stop driving to lift the load or stop lifting the load in order to drive. This greatly limits the operation of the unit as it is fairly common to reach this pressure while driving only, such as turning in loose soil or digging a hole for example.

In effect, one can only have half of the power available which the unit is capable of generating. This becomes particularly apparent when operating an attachment from the auxiliary outlets that requires a lot of power and that the unit has to be moving to use. A trencher, snowblower, or tiller would be examples of this type of application.

SUMMARY OF THE INVENTION

The present invention addresses the above mentioned disadvantages and weaknesses of the current arrangement for drive systems and provides a unique solution to these short comings. In the system according to the invention, a tandem hydraulic pump is used which in effect is two separate pumps in a common body. However, two interconnected individual pumps could also be used. Each of these pumps is connected to a multiple spool series valve, preferably at least a three spool series control valve. This creates two separate hydraulic circuits, each of which has a separate relief valve.

In the illustrated example described hereafter, each of the multiple, at least, three spool valves controls one wheel motor and one loader function such as the lift or a bucket and a third spool on each valve is a single acting spool and these two "third" spools both connect to a separate spool valve to provide auxiliary power control.

In this arrangement, wheel motors are in separate hydraulic circuits and operate independent of each other. Thus one wheel motor does not see the other one as back pressure and each has the full flow and pressure of its own pump available to it. This dramatically improves the driving ability of the unit as it results in double the power and torque available at the wheel motors than conventional versions, all else being equal.

According a broad aspect, the invention relates to a drive and operating system for mini-loader or like machines incorporating hydraulically operated wheels and other functional mechanisms. The drive and operating system comprises a pair of hydraulic pumps and engine means for driving the pumps; a pair of multiple-spool series control valves, each hydraulically connected to one of the hydraulic pumps to provide two separate hydraulic circuits; a driving wheel and a loader function each being hydraulically and separately connected to individual spools in each of the multiple-spool series control valves; and a separate spool control valve hydraulically connected to a third spool in each of the multiple-spool series control valves, the separate spool control valve providing power central to an auxiliary function.

DESCRIPTION OF THE DRAWINGS

The invention is illustrated by way of example in the accompanying drawings in which.

DESCRIPTION OF THE PREFERRED EMBODIMENT

Figure 1:
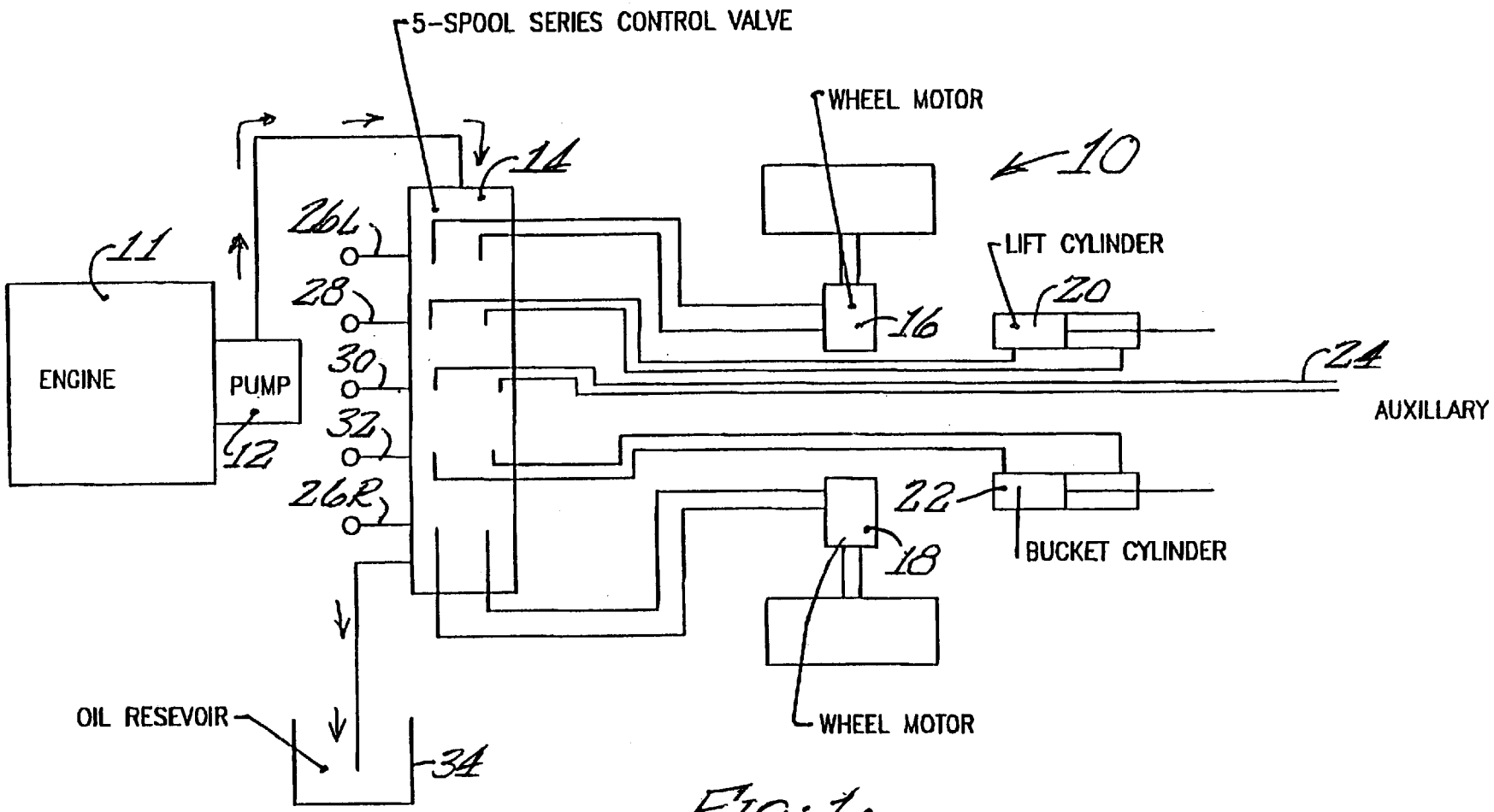
FIG. 1. PRIOR ART
FIG. 1 illustrates a typical hydraulic arrangement for a conventional drive system.

Referring initially to FIG. 1, a hydraulic arrangement for a drive system for a vehicle such as a mini loader, is illustrated at 10 and is typically of hydraulic drive arrangements for conventional machines of this general type.

In this conventional arrangement 10, a single hydraulic pump 12 is driven by suitable motor means 11 such as a constant speed gasoline powered engine. Pump 12 is connected to a control valve 14 and which, as illustrated, is a five-spool series control valve which provides control for the drive hydraulic motors and loader cylinders as well as auxiliary functions. Accordingly, control valve 14 has operating lever 26L to control the left wheel motor 16; lever 26R which controls the right wheel motor 18; lever 28 which controls the lift cylinder 20; lever 32 which controls the bucket cylinder 22; and lever 30 which provides control for an auxiliary function.

As described earlier, when more than one of the levers 26–32 is operated, hydraulic oil is allowed to flow to more than one function. However, the hydraulic oil will follow the path of least resistance and only the function which requires the lowest pressure at the time will actually operate. With the series valve 14, the hydraulic oil coming "back" to the valve 14 from one function (such as the lift cylinder 20) will go out to the next function such as the bucket cylinder 22 when lever 32 is pulled. Accordingly, several functions can be operated at the same time so that, for example, the machine can be driven forwards as the oil coming out of one wheel motor 16 is going to the other wheel motor 18.

As described earlier, the disadvantage of this system is that the pressures are additive because any function will see any other function downstream thereof as back pressure. Accordingly, if a machine was being driven in a straight line and the pressure required to turn each wheel motor 16, 18 was a 1000 psi, the total pressure required would be 2000 psi and if the operator tried to lift a load at the same time and that load required 1500 psi to lift it, the total system pressure would become 3000 psi. Because the hydraulic systems in these conventional units operate at a maximum pressure of 3000 psi the system relief valve will open and dump all the oil back to the reservoir when this pressure is reached. The result of this is that everything stops until the pressure drops below the limit again. It will be appreciated that this greatly limits the operation of the unit as it is fairly common to reach maximum pressure while doing driving only such as turning in loose soil or digging a hole for example. In effect, the operator can have only half of the power the unit is capable of generating to him. This can become particularly apparent when operating an attachment on the auxiliary outlets 24 that requires a lot of power.

Figure 2:
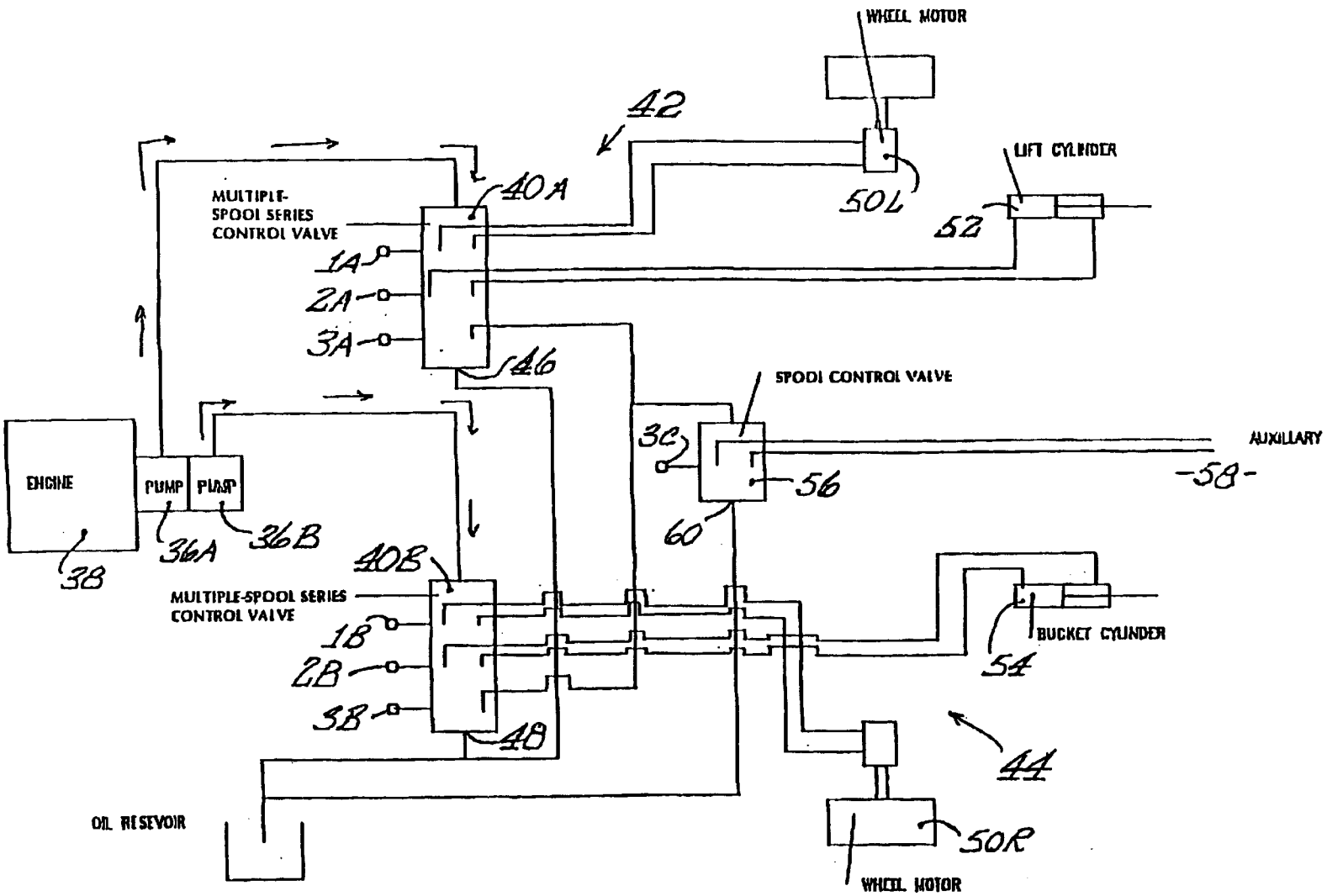
FIG. 2 illustrates a hydraulic layout for a drive system according to the present invention.

FIG. 2 illustrates a drive and operating system for mini-loaders or like machines, in accordance with the present invention. It will be appreciated that this drive system is applicable to mini-skid steer units, small backhoes or other types of machines and while the drawings and disclosure refer to left and right wheels, the units could well use tracks instead of wheels. In many small loader type of vehicles, one set of hydraulically operated wheels are interconnected by sprockets or chains, or sometimes tracks, to adjacent idler wheels.

As shown in FIG. 2, the system according to the present invention utilizes a tandem hydraulic pump which in effect is two separate pumps 36A and 36B in a common housing. Pumps 36A and 36B are driven by a suitable engine 38. Each pump is connected to a multiple spool series control valve, for example, a 3-spool series control valve and thus pump 36A is connected to control valve 40A and pump 36B is connected to control valve 40B. This arrangement creates two separate hydraulic circuits, 42 and 44 each of which has its own, separate relief valve, 46 for circuit 42 and 48 for circuit 44.

In the illustrated example, each of the multiple spool valves 40A, 40B controls one wheel motor and one loader function such as a lift or bucket. Spool valve 40A controls left wheel motor 50L through lever 1A and one function such as a lift cylinder 52 through lever 2A.

In circuit 44, control valve 40B governs the right wheel motor 50R through lever 1B and the function cylinder such as a bucket cylinder 54 through lever 2B. The third spool, 3A on control valve 40A and 3B on control valve 40B are each single acting spools and they are both connected to a single spool valve 56 which, through level 3C, provides control for auxiliary 58. The single spool control valve 56 has a relief valve 60.

In this arrangement, the wheel motors 50L, 50R are in separate hydraulic circuits, 42, 44 respectively and operate independent of each other. One wheel motor does not see the other one as back pressure and each wheel motor 50L, 50R has the full flow and pressure of its own pump 36A or 36B, available to it. This dramatically improves the driving ability of the unit as it results in double the power and torque available at the wheel motors 50L, 50R when compared with a conventional version, all other things being equal.

Wheel motor 50L would still detect a loader function such as the lift cylinder 52 as back pressure. However, this does not pose any difficulties as the pressure on these functions is generally lower and only one wheel motor is involved.

The arrangement of the auxiliary control valve 56 is to be noted. It is operated by the single spool valve 3C which in turn is connected to the last spool, 3A or 3B, in both of the multiple or three-spool series valves 40A and 40B in the illustrated embodiment. Accordingly, this auxiliary circuit can be turned off or on at the operator's choice from either or both of the multiple-spool valves 40A or 40B. This gives an operator a choice of flow rates for his auxiliary functions on the machine.

Although the wheel motors 50L, 50R would see an auxiliary function as back pressure, valve 56 has its own relief valve 60 which can be set at a lower release pressure than those on the main multiple-spool valves 40A and 40B. If this pressure is exceeded, the attachment would stop but there would still be flow and whatever the pressure differential was between the relief valves is available to operate the earlier functions, and the unit would still be drivable.

Tests have shown that, because of the dramatic power increase this system provides, the pumps 36A, 36B and wheel motors 50L, 50R can be smaller than those used in conventional versions and still achieve a significant rise in power and performance. For example, if an 8 gallon per minute pump was used with 24 cubic inch motors in a conventional version a drive system according to the present invention for example could use 2–6 gallon per minute pumps with 18 cubic inch motors that would still represent a 50% increase in power and wheel torque. This would also provide a choice of 6 or 12 gpm to the auxiliary circuit rather than only 8 gpm in a conventional arrangement.

While several forms of multiple series valves are useable in the present invention, three-spool series valves are preferred as they are available in a monobloc configuration whereas five-spool valves for example are generally sectional valves, monobloc valves are generally more economical than sectional valves. As a result of this, the system according to the present invention is proving to be actually more economical than earlier systems. It has also been found to be more user friendly as the oil flows are smaller and easier for the operator to control.

Again, it will be appreciated that the drive system according to the present invention is not restricted in its use to mini-loaders or mini-skid steer units. The benefit of a split drive hydraulic drive system according to the invention applies to many forms of many units such as backhoes, track drives instead of wheel drives, or the like.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. A drive and operating system for mini-loader or like machines incorporating hydraulically operated wheels and other functional mechanisms, said drive and operating system comprising:

a pair of hydraulic pumps and engine means for driving said pumps;

a pair of multiple-spool series control valves, each hydraulically connected to one of said hydraulic pumps to provide two separate hydraulic circuits;

a driving wheel and a loader function each being hydraulically and separately connected to individual spools in each of said multiple-spool series control valves;

and a separate spool control valve hydraulically connected to a third spool in each of said multiple-spool series control valves, said separate spool control valve providing power central to an auxiliary function.

2. A drive and operating system according to claim 1 wherein said hydraulic pumps are tandem mounted to said engine means.

3. A drive and operating system according to claim 2 wherein said engine means is an internal combustion engine.

4. A drive and operating system according to claim 1 wherein said engine means is an internal combustion engine.

5. A drive and operating system according to claim 1 wherein said multiple spool series control valves are at least three-spool series control valves.

6. A drive and operating system according to claim 5 wherein said multiple-spool series control valves are at least three-spool series control valves, one spool thereof controlling a driving wheel, a second spool controlling a loader function such as a bucket cylinder or lift cylinder and a third spool being hydraulically connected to said separate spool control valve for auxiliary functions.

7. A drive and operating system according to claim 1 wherein said multiple-spool series control valves are at least three-spool series control valves, one spool thereof controlling a driving wheel, a second spool controlling a loader function such as a bucket cylinder or lift cylinder and a third spool being hydraulically connected to said separate spool control valve for auxiliary functions.

8. A drive and operating system according to claim 7 wherein said separate spool control valve is a single spool control valve.

9. A drive and operating system according to claim 1 wherein said separate spool control valve is a single spool control valve.

* * * * *